US011428068B2

(12) United States Patent
Saraya

(10) Patent No.: US 11,428,068 B2
(45) Date of Patent: Aug. 30, 2022

(54) METHODS AND SYSTEMS FOR A TEMPORARY SEAL WITHIN A WELLBORE

(71) Applicant: Vertice Oil Tools, Missouri City, TX (US)

(72) Inventor: Mohamed Ibrahim Saraya, Sugar Land, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 252 days.

(21) Appl. No.: 16/523,692

(22) Filed: Jul. 26, 2019

(65) Prior Publication Data

US 2020/0131884 A1 Apr. 30, 2020

Related U.S. Application Data

(63) Continuation of application No. 62/864,681, filed on Jun. 21, 2019.

(60) Provisional application No. 62/750,903, filed on Oct. 26, 2018.

(51) Int. Cl.

| | |
|---|---|
| ***E21B 33/16*** | (2006.01) |
| ***E21B 34/06*** | (2006.01) |
| *E21B 21/10* | (2006.01) |
| *E21B 34/14* | (2006.01) |

(52) U.S. Cl.

CPC ..... *E21B 33/16* (2013.01); *E21B 34/063* (2013.01); *E21B 21/103* (2013.01); *E21B 34/14* (2013.01)

(58) Field of Classification Search

CPC ..... E21B 33/1208; E21B 33/16

See application file for complete search history.

(56) References Cited

U.S. PATENT DOCUMENTS

| | | | | |
|---|---|---|---|---|
| 4,442,894 | A * | 4/1984 | Callihan | E21B 33/16 166/156 |
| 5,165,473 | A * | 11/1992 | Bode | E21B 33/16 166/156 |
| 2003/0062161 | A1 | 4/2003 | Mondelli | |
| 2007/0261850 | A1 | 11/2007 | Giroux | |
| 2011/0180274 | A1* | 7/2011 | Wang | E21B 34/14 166/386 |
| 2011/0247833 | A1 | 10/2011 | Todd | |
| 2014/0060813 | A1 | 3/2014 | Utex | |
| 2014/0138097 | A1* | 5/2014 | Andrigo | E21B 33/12 166/373 |

(Continued)

OTHER PUBLICATIONS

International Search Report, PCT/US2019/051198, child case, dated Nov. 21, 2019.

*Primary Examiner* — Robert E Fuller
*Assistant Examiner* — Theodore N Yao
(74) *Attorney, Agent, or Firm* — Pierson IP, PLLC

(57) ABSTRACT

A temporary seal may be configured to be initially positioned on a seal seat within casing, and be configured to be broken or disengaged by increasing the pressure within the inner diameter of the casing past a pressure threshold. Subsequent to the temporary seal being broken, a first portion of the temporary seal may remain on the seal seat while a second portion of the temporary seal may travel downhole through a landing collar. Then, cement may be pumped within the casing, followed by a wiper plug. The wiper plug may pass the seal seat, and be locked in place on the landing collar. The cement may cure and remaining portions of the temporary seal may dissolve.

18 Claims, 17 Drawing Sheets

(56) References Cited

U.S. PATENT DOCUMENTS

| | | | | |
|---|---|---|---|---|
| 2014/0216756 | A1* | 8/2014 | Getzlaf | E21B 33/146<br>166/376 |
| 2016/0010400 | A1* | 1/2016 | Goebel | E21B 23/04<br>166/285 |
| 2016/0069462 | A1* | 3/2016 | Petrowsky | F16K 17/162<br>220/89.2 |
| 2016/0333660 | A1* | 11/2016 | Dedman | E21B 33/1208 |
| 2017/0247978 | A1* | 8/2017 | Budler | E21B 34/14 |
| 2018/0112487 | A1* | 4/2018 | Budde | E21B 33/14 |
| 2018/0324026 | A1* | 11/2018 | Yong | E21B 33/12 |
| 2019/0106959 | A1* | 4/2019 | Leonard | C22C 22/00 |

* cited by examiner

METHODS AND SYSTEMS FOR A TEMPORARY SEAL WITHIN A WELLBORE

BACKGROUND INFORMATION

Field of the Disclosure

Examples of the present disclosure relate to a temporary seal within a wellbore. More specifically, embodiments include a temporary seal within casing that limits the flow of fluid through the casing until the temporary seal is released, wherein a wiper plug is configured to move within the casing after the temporary seal is released.

Background

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Casing may be run through the drilled horizontal, vertical or deviated wells to reach the reservoirs across the horizontal axis. To take advantage of the buoyancy phenomena to allow moving the casing through with the lowest drag and torque, it may be more effective to not fill part of or the entire casing with fluid or fill it with lighter fluid while moving the casing towards the distal end of the horizontal well.

Accordingly, needs exist for systems and methods utilizing a temporary seal within a casing, wherein the temporary seal may be broken based on weak points positioned within the temporary seal. After the temporary seal is removed, a wiper plug may pass through the casing and be positioned on a landing collar.

SUMMARY

Embodiments disclosed herein describe systems and methods utilizing a temporary seal within a casing, tool, or any other device with an inner diameter (referred to individually and collectively hereinafter as "casing"). The temporary seal may be configured to be initially positioned on a seal seat within casing, and be configured to be broken or disengaged by increasing the pressure within the inner diameter of the casing past a pressure threshold. Subsequent to the temporary seal being broken, a first portion of the temporary seal may remain on the seal seat while a second portion of the temporary seal may travel downhole through a landing collar. Then, cement may be pumped within the casing, followed by a wiper plug. The wiper plug may pass the seal seat, and be locked in place on the landing collar. The cement may cure and remaining portions of the temporary seal may dissolve.

Embodiments may include a casing, temporary seal, and a wiper plug.

The casing may be configured to be installed into a well before other tools or equipment is run into the well. The casing may include a hollow channel, passageway, conduit, etc. extending from a proximal end of the casing to a distal end of the casing. The casing may be a hollow diameter pipe that is assembled and inserted into a recently drilled section of a borehole. The casing may include a seal seat and landing collar that decrease the inner diameter across the casing.

The temporary seal may be a disc, sphere, ball, ball with milled slots, a combination, or any object that is configured to temporarily block the inner diameter across the casing. The temporary seal may be comprised of dissolvable or other materials that may disappear under the influence of temperature, solvent, flow or combination. The temporary seal may have varying thicknesses, which may cause breakpoints at positions that have smaller thicknesses. This may allow portions of the temporary seal to separate from each other in a controlled and predetermined fashion, and then travel downhole to not impede a subsequent cementing operation or other operations that may require the ability of circulations. The portions of the temporary seal may dissolve to expose a full bore diameter to allow subsequent downhole operations or allow larger flow area. In embodiments, a first portion of the temporary seal may be configured to travel downhole from the seal seat, while a second portion of the temporary seal remains on the seal seat.

The wiper plug may be configured to remove cement, debris, and other objects from an inner diameter of the casing after cement has been pumped through the casing. The wiper plug may include wipers, darts and an expandable segment, expandable rings, or a combination. The wipers may be configured to be positioned adjacent to the inner diameter of the casing while moving through the casing, and the expandable segments may be configured to expand responsive to being positioned on the landing collar. In embodiments, the expandable segments may not be configured to expand when passing the second segment of the temporary seal that is positioned on the seal seat.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
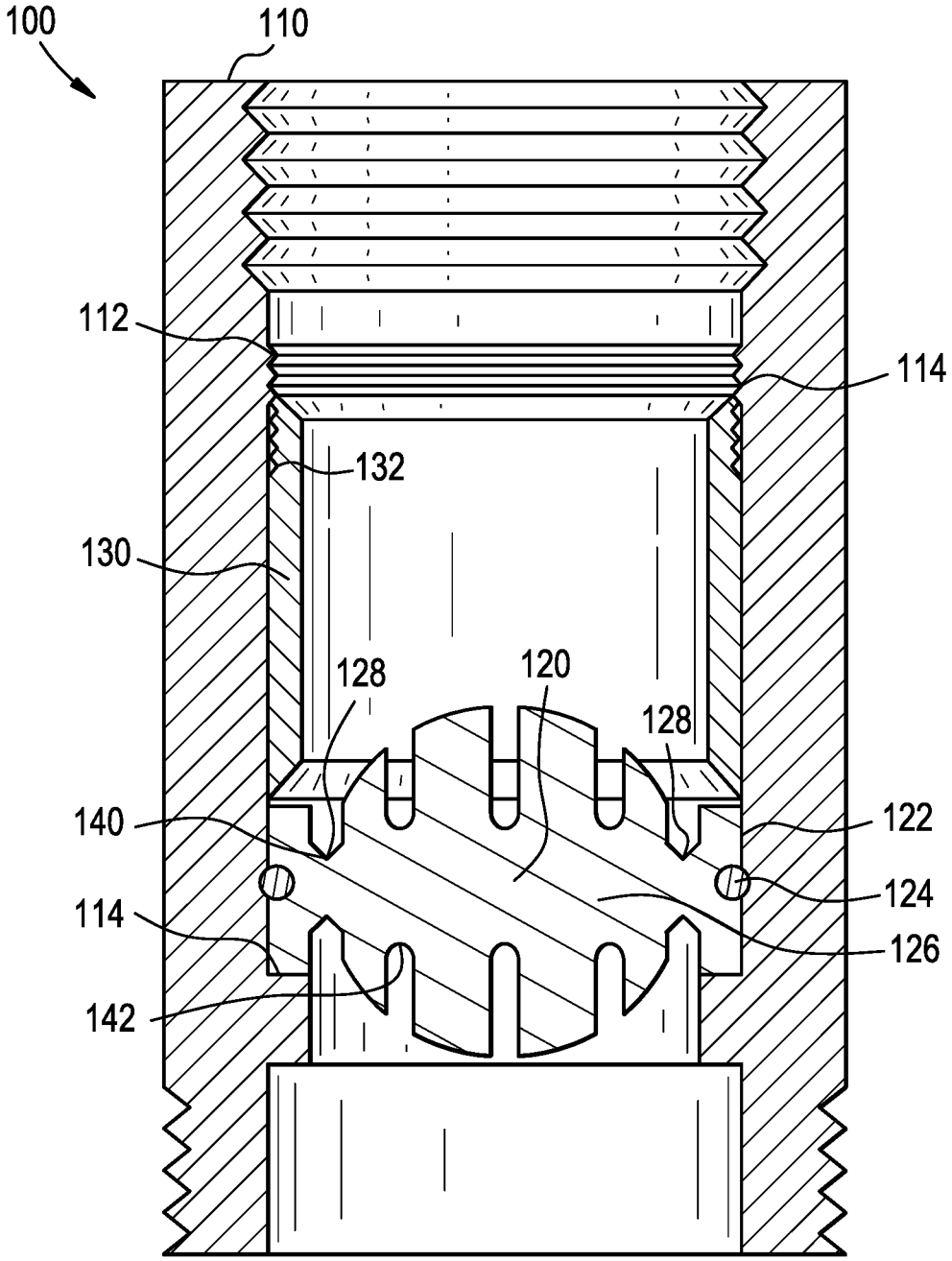
FIG. 1 depicts a system to temporarily seal casing within a wellbore, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a system 100 to temporarily seal casing within a wellbore, according to an embodiment. System 100 may include casing collar 110, temporary seal 120, and holding element 130 that may be of any shape, size, orientation, or configuration.

Casing collar 110 may be a casing collar that connects directly to the casing, it may be made of one piece and have in inner diameter that includes first threads 112 and ledge, a no go, or restriction 114 (hereinafter referred to as "seat 114"). Threads 112 may be configured to interface with second threads 132 on holding element 130 to allow holding element 130 to move in a direction that is in parallel to the longitudinal axis of casing collar 110. In other embodiments, temporary seal 120 may be mounted directly on the casing collar 110, removing the need holding element 130 and restriction 114 to secure temporary seal 120 to casing collar 110.

Seat 114 may be a projection, shelf, etc. that extends towards a central axis of Casing collar 110, which may decrease the inner diameter of Casing collar 110 from a first diameter to a second diameter. Seat 114 may be configured to receive temporary seal 120 to hold temporary seal 120 in place. In other embodiments, holding element 132 may be eliminated and temporarily blocking element may be threaded, or connected directly to casing collar 110 inner diameter Temporary seal 120 may be a disc, ball, ball with machined slots, a combination, or any object that is be configured to sit on seat 114 when temporary seal 120 is intact or fully formed. This may cause a seal within casing collar 110, which may isolate areas above temporary seal 120 from areas below temporary seal 120. Responsive to portions of temporary seal 120 dissolving, shearing, breaking apart, all or portions of temporary seal 120 may pass seat 114 and more downhole. Responsive to blocking element passing through seat 114, the seal may no longer be formed across casing collar 110, which may no longer isolate areas above and below temporary seal 120. Temporary seal 120 may include a first portion 122, sealing element 124, and second portion 126.

First portion 122 of temporary seal 120 may be configured to be positioned on seat 114. First portion 122 may be coupled to the inner diameter of casing collar 110 via seals 124, which may restrict fluid from flowing between first portion 122 and the inner diameter of casing collar 110. In embodiments, first portion 122 may have a first thickness. In embodiments, first portion 122 of temporary seal 120 may be positioned on seat 114 when first portion 122 and second portion 124 are coupled together, as well as when second portion is decoupled from first portion. After a period of time, first portion 122 may be configured to dissolve, disappear, etc. while positioned on seat 114, and being decoupled from second portion 126. This may allow for the entire inner diameter of casing collar 110 to not be exposed initially, and allow a wiper or other elements to move downhole. In other embodiments, second portion 126 seal 126 may be removed, and temporary seal 120 may be secured in place by means of a crushing force generated by tightening holding element 130 against the seat 114.

Second portion 126 of temporary seal 120 may be positioned between circumferences of first portion 122. Second portion 126 may include a series of ridges and grooves. This may allow for second portion 126 to have a variable thickness, and an increased surface area. The variable thickness across second portion may create breakpoints 128, where segments of temporary seal 120 may be partitioned from each other based on a pressure differential above temporary seal 120 and below temporary seal 120. In embodiments, the ridges and grooves may be positioned on both upper and lower surfaces of temporary seal 120, wherein the grooves may be aligned with each other on both the upper and lower surfaces, in other circumstances the grooves may not be aligned. The increased exposed surface area created by the grooves and ridges may enable for a faster rate of dissolution.

Breakpoints 128 within second portion may have varying thicknesses, which are smaller than the first thickness of first portion 122. The breakpoints 128 with the smallest thickness may be configured to shear partitions of second portion 126 from first portion 122, as well as other portions of second portion 126. In embodiments, breakpoints 128 may shear temporary seal 120 into different segments, fragments, etc. based on a pressure differential across a corresponding breakpoint 128, which correlates to thickness, special coating, chemical or heat treatment of the breakpoint 128. By varying the thicknesses or treatments of different breakpoints, temporary seal 120 may be configured to segment at different times based on different pressure differentials across different chords of temporary seal 120. Furthermore, the varying thickness of second portion 126 may increase the surface area of temporary seal 120. This may allow more fluid to interact with the surface of temporary seal 120, which may increase a dissolving rate of temporary seal 120.

Holding element 130 may be a device that is configured to be positioned adjacent to the inner sidewalls of the casing collar 110. Holding element 130 may include threads 130 that are configured to interface with the threads 112 on the casing collar 110. Threads 132 may be configured to allow holding element 130 to be coupled with casing collar 110 and move in a direction in parallel to the longitudinal axis of casing collar 110. Utilizing the threads, holding element 130 may move towards the distal end of casing collar 110, allowing a distal end of holding element 150 to apply forces and hold against first portion 122 of temporary seal 120 on seat 114. In other embodiments, temporary seal 120 can be directly connected, threaded to the inner diameter of casing collar 110 inner diameter above seat 114. In other embodiments, threads 112 maybe any other coupling method, and holding element 130 maybe made out of dissolvable, removable, or any other disappearing material.

Figure 2:
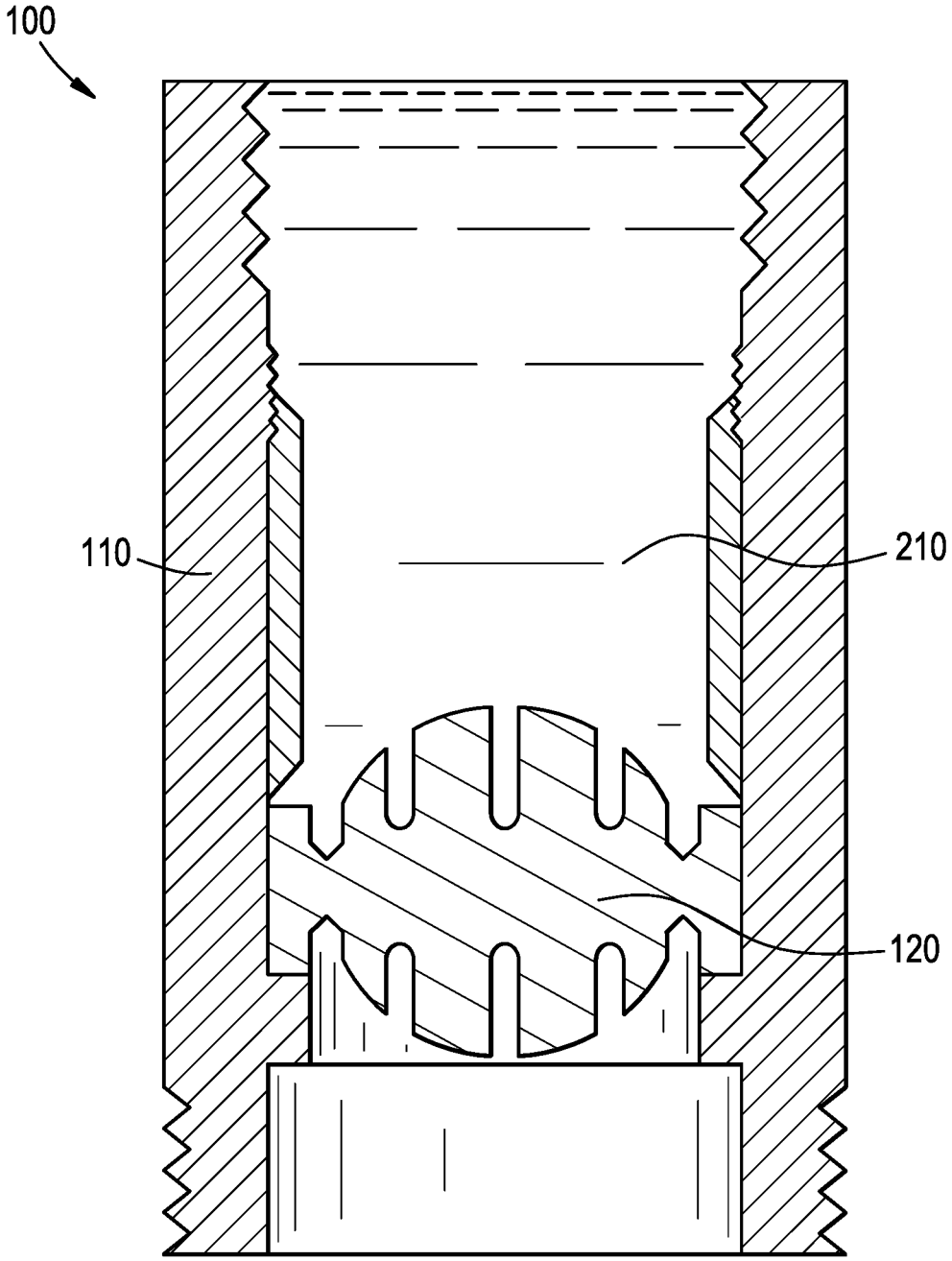
FIG. 2 depicts system to temporarily seal casing within a wellbore, according to an embodiment.

FIG. 2 depicts system 100, according to an embodiment. Elements depicted in FIG. 2 may be described above. For the sake of brevity, another description of those elements is omitted.

As depicted in FIG. 2, responsive to flowing fluid 210 within the hollow chamber within casing collar 110, temporary seal 120 may restrict the movement of the fluid through casing collar 110. Specifically, temporary seal 120 may contain the fluid in a first portion of the wellbore above temporary seal 120, wherein the fluid may not travel to a second portion of the wellbore below temporary seal 120.

Figure 3:
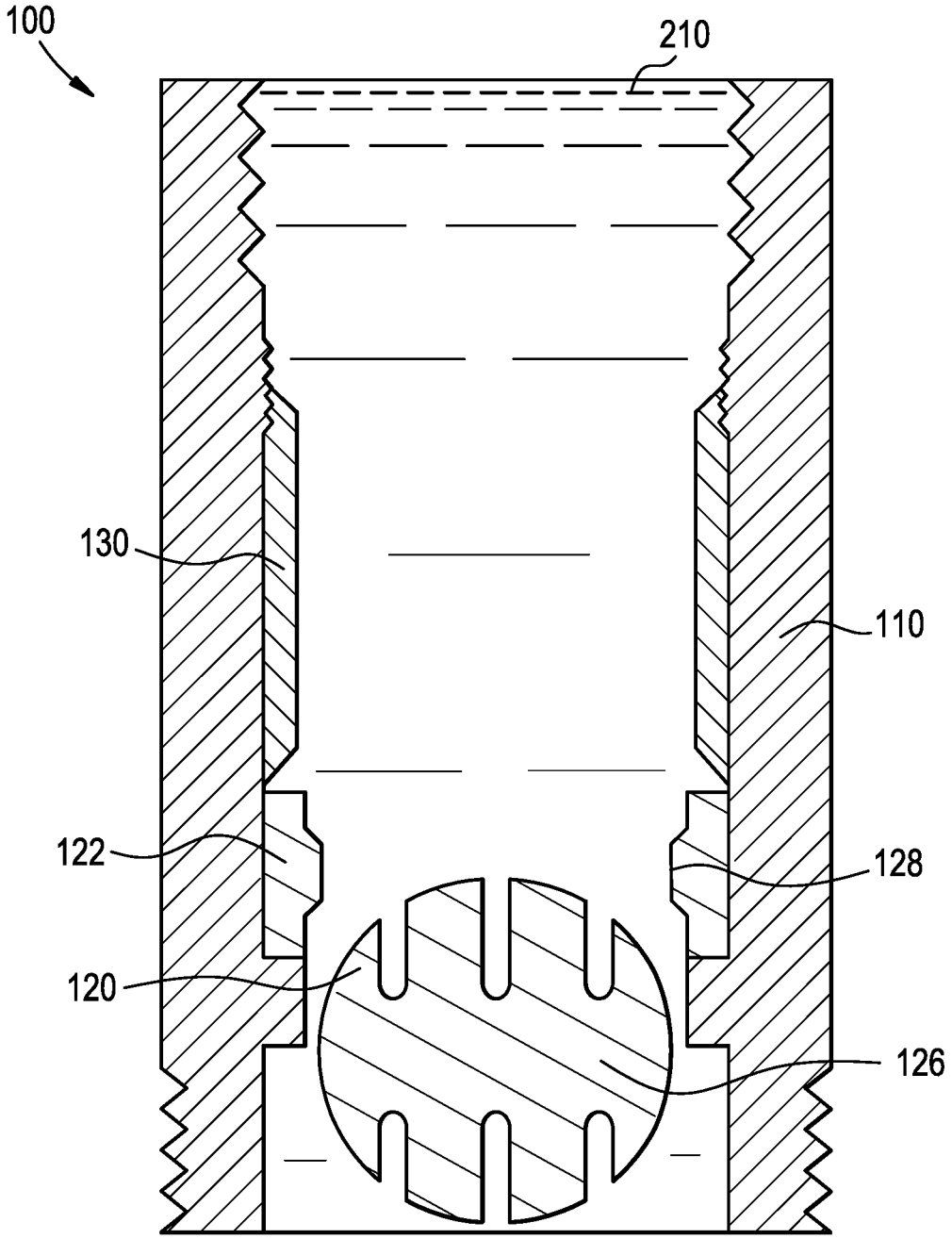
FIG. 3 depicts system to temporarily seal casing within a wellbore, according to an embodiment.

FIG. 3 depicts system 100, according to an embodiment. Elements depicted in FIG. 3 may be described above. For the sake of brevity, another description of those elements is omitted.

As depicted in FIG. 3, responsive to the fluid 210 within the casing collar 110 above temporary seal 120 creating a pressure differential across breaking point 128 being greater than a breaking threshold based in part of the thickness of breaking point 128, or due to breaking point quicker dissolution of from temperature or solvent fluid, a first portion 122 of temporary seal 120 may be separated from a second portion 126 of temporary seal 120. Specifically, temporary seal 120 may be partitioned at a point with the shortest thickness. This may due to the thicker portions of temporary seal 120 ability to receive more stress than thinner portions of temporary seal 120.

This may enable second portion 126 of temporary seal 120 to be separated from first portion 122 of temporary seal 120, and second portion 126 of temporary seal 120 may retain a substantially spherical shape. Furthermore, responsive to second portion 126 of temporary seal 120 being separated from first portion 122, the ridges and grooves on a lower side of second portion 126 of temporary seal 120 maybe be exposed to fluid 210. This may increase a rate of dissolving of second portion 126 of temporary seal 120 since more surface area will be exposed to dissolving fluid. Also, the second portion 126 of temporary seal 120 may be configured to move downhole with the flow of fluid, while first portion 122 of temporary seal 120 remains on sat 124. This may cause continuous and even exposure of the dissolvable materials of second portion 124 of temporary seal 120 to the dissolving fluid, which may allow it to dissolve faster.

As a result of second portion 126 of temporary seal 120 separating from first portion 122 of temporary seal 120, an inner diameter of first portion 122 may have a first diameter that is exposed to the dissolving fluid, temperature, and start dissolving. After a desired period of time, the inner diameter of casing 110 above seat 124 may increase, while first portion 122 dissolves either partially or fully.

Figure 4:
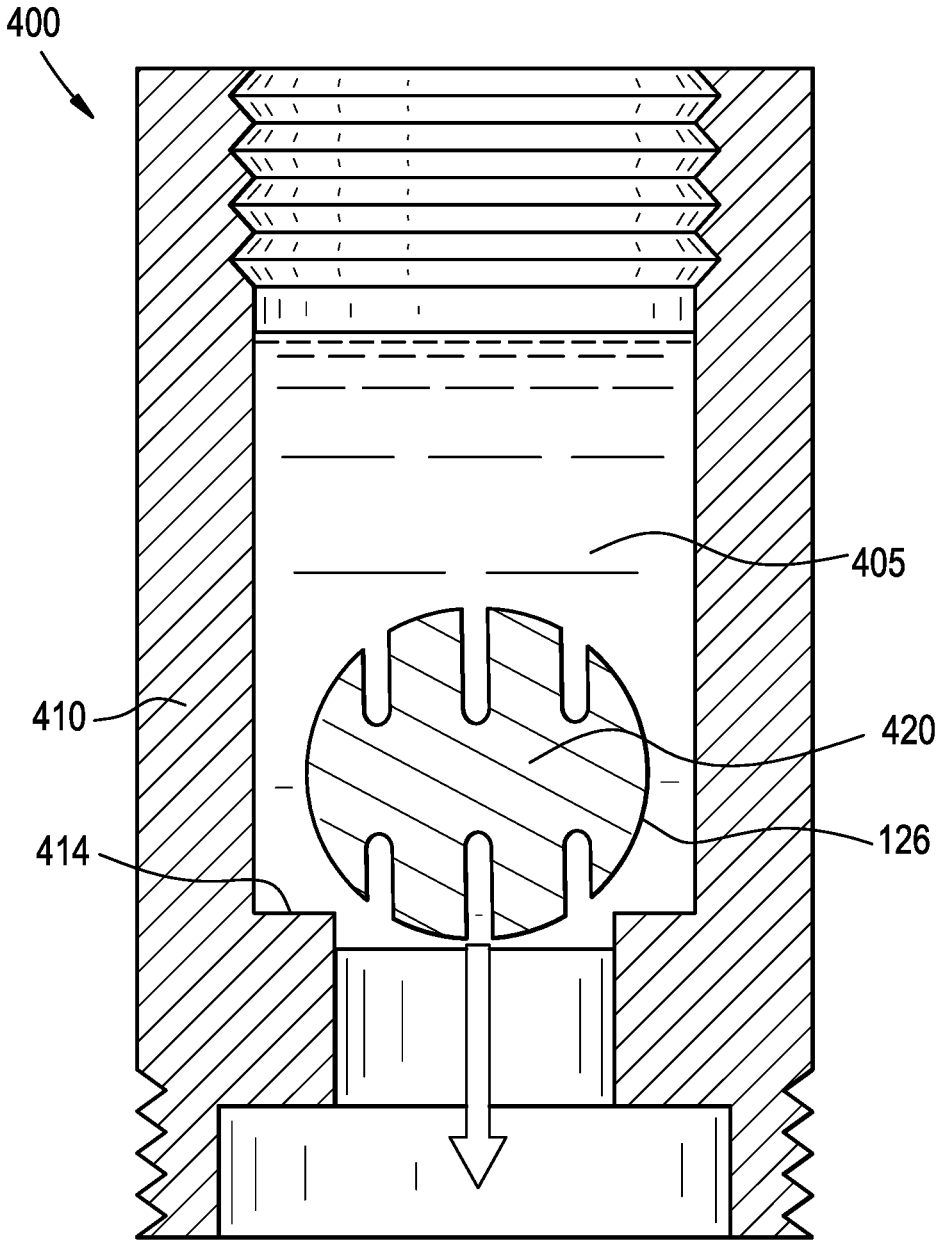
FIG. 4 depicts system to temporarily seal casing within a wellbore, according to an embodiment.

FIG. 4 depicts system 400, according to an embodiment. Elements depicted in FIG. 4 may be described above. For the sake of brevity, another description of those elements is omitted.

As depicted in FIG. 4, a temporary seal 420 flowing down hole with fluid till hit any obstruction may be positioned on a ledge 414 of casing collar 410, wherein temporary seal 420 may not be secured in place. When initially positioned on ledge 414, temporary seal 420 may have a first diameter, which is greater than a second diameter across ledge 414.

In this embodiment, temporary seal 420 may not be directly coupled to the inner sidewalls of casing 414. As such, fluid 405 may flow around temporary seal 420, while temporary seal 420 restricts, reduces, etc. a fluid flow rate of fluid 405 through the casing collar 410. Due to the series of ridges and grooves within temporary seal 420, temporary seal 420 may not be configured to fully seal the inner diameter of casing collar 410. This may be due to an upper edge of a groove being positioned above ledge 414, and a lower edge of the groove being positioned below ledge, wherein fluid may flow through the groove. This will ensure that remnant of temporary seal 420 may not block or create any obstruction to flow downhole. In other embodiment, the ledge 414 may be flat, uneven plate with holes that may allow to flow at higher flow area. The holes may extend from an upper surface of the plate to a lower surface of the plate, allowing communication from an area above temporary seal 420 to an area below temporary seal 420 through the holes.

Figure 5:
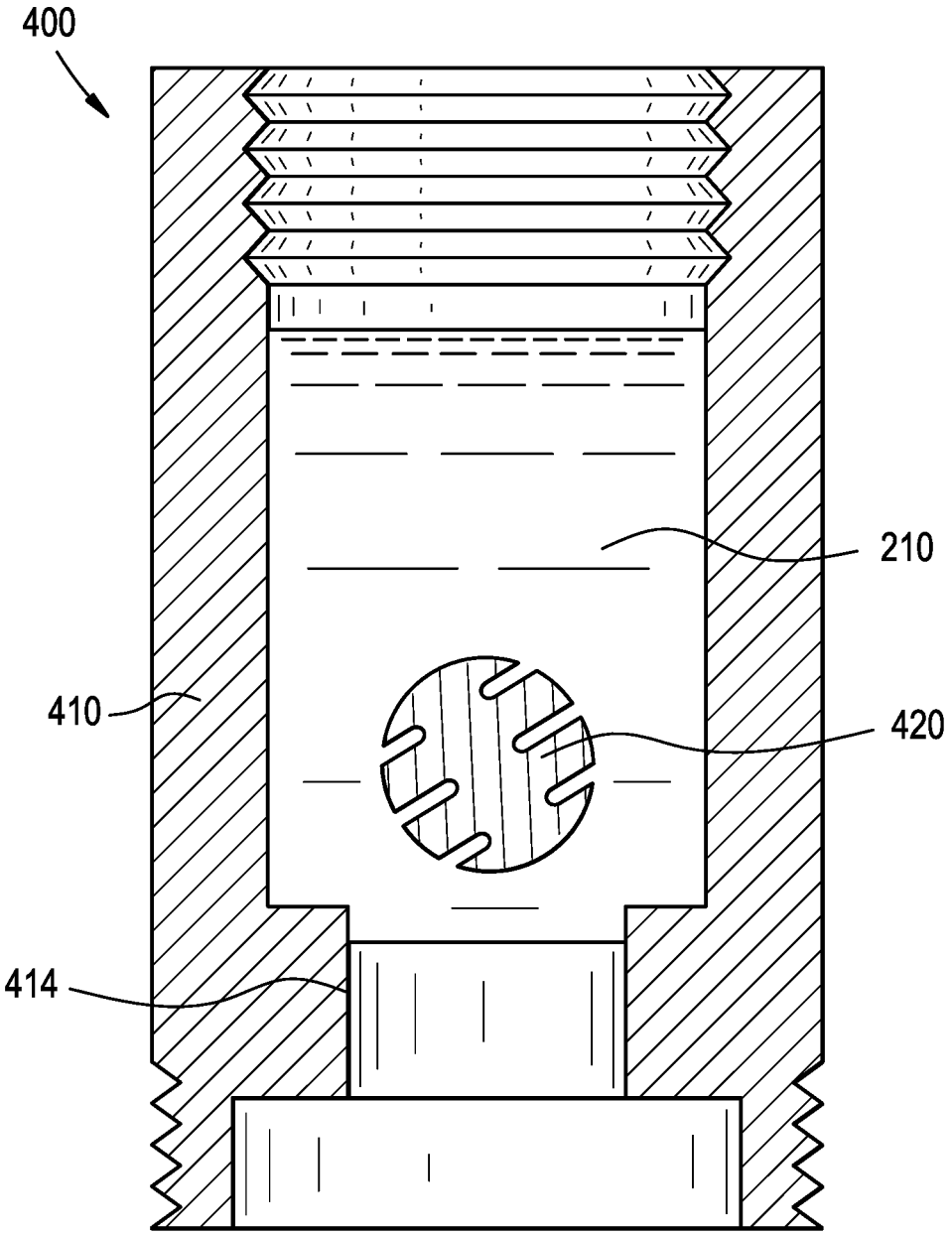
FIG. 5 depicts system to temporarily seal casing within a wellbore according to an embodiment.

FIG. 5 depicts system 400, according to an embodiment. Elements depicted in FIG. 5 may be described above. For the sake of brevity, another description of those elements is omitted.

As depicted in FIG. 5, responsive to temporary seal 420 being in contact with fluid 405 and continuous circulation, portions of temporary seal 420 may dissolve and disappear. This may cause the first diameter of temporary seal 420 to shrink to a third diameter, wherein the third diameter is less than the second diameter associated with a distance across ledge 414. When the diameter associated with temporary seal 420 is less than the diameter associated with ledge 414, temporary seal 420 may flow downhole past ledge 414 and any other restriction while continuously dissolving. This process may be repeated if temporary seal 420 with third diameter land on another obstruction that has a ledge inner diameter smaller than its third diameter.

Figure 6:
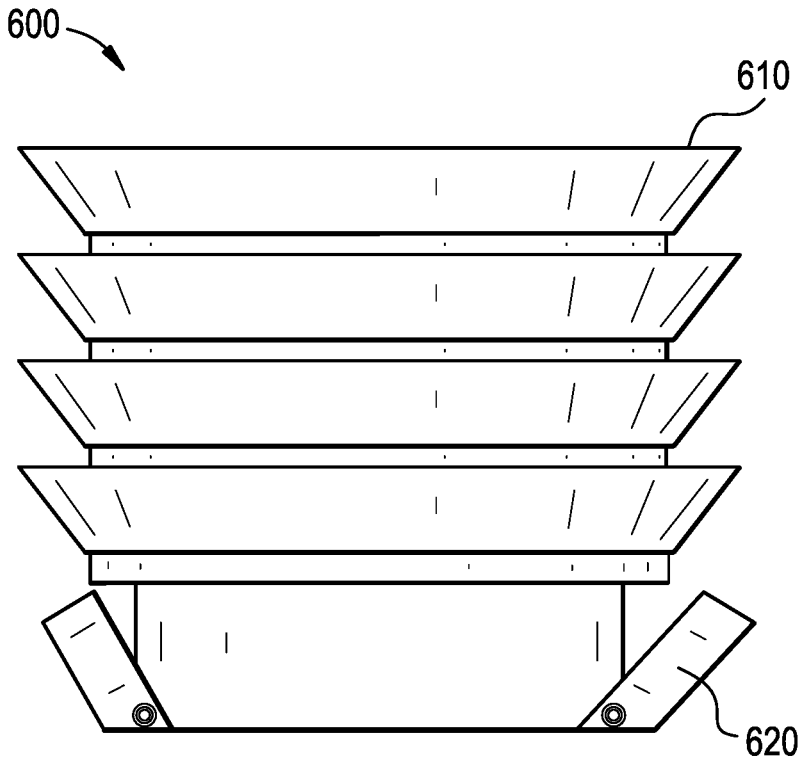
FIG. 6 depicts a wiper plug, according to an embodiment.

FIG. 6 depicts a wiper plug 600, according to an embodiment. Wiper plug 600 may be configured to remove cement and other materials from an inner diameter or circumference of a casing. Wiper plug 600 may include fins 610 and expandable segment or ring 620. In another embodiment, the wiper plug may be an expandable/collapsible ball that passes through restrictions by collapsing and expanding in bigger diameter. In embodiments, the ball can be made of rubber or any other flexible material.

Fins 610 may be projections that extend away from a central axis of wiper plug 600, and may be configured to contact the inner circumference of the casing while moving downhole. Fins 610 may have tapered ends that allow movement in a single direction within casing. The tapering of fins 610 may allow for a first end of fins 610 to have a larger diameter than that of a second end of fins 610, wherein the first ends of fins 610 are positioned closer to a proximal end of wiper plug 600 than the second ends of fins 610.

Expandable segments 620 may be positioned on a distal or proximal end of wiper plug 600. Expandable segments 620 may be configured to increase the outer diameter of wiper plug 600 based on an inner circumference of the casing. In embodiments, expandable segments 620 may be configured to increase in size. This may limit the movement of wiper plug 600 to only be able to move to areas with a smaller inner diameter than that of expandable segments 620 while collapsed.

Figure 7:
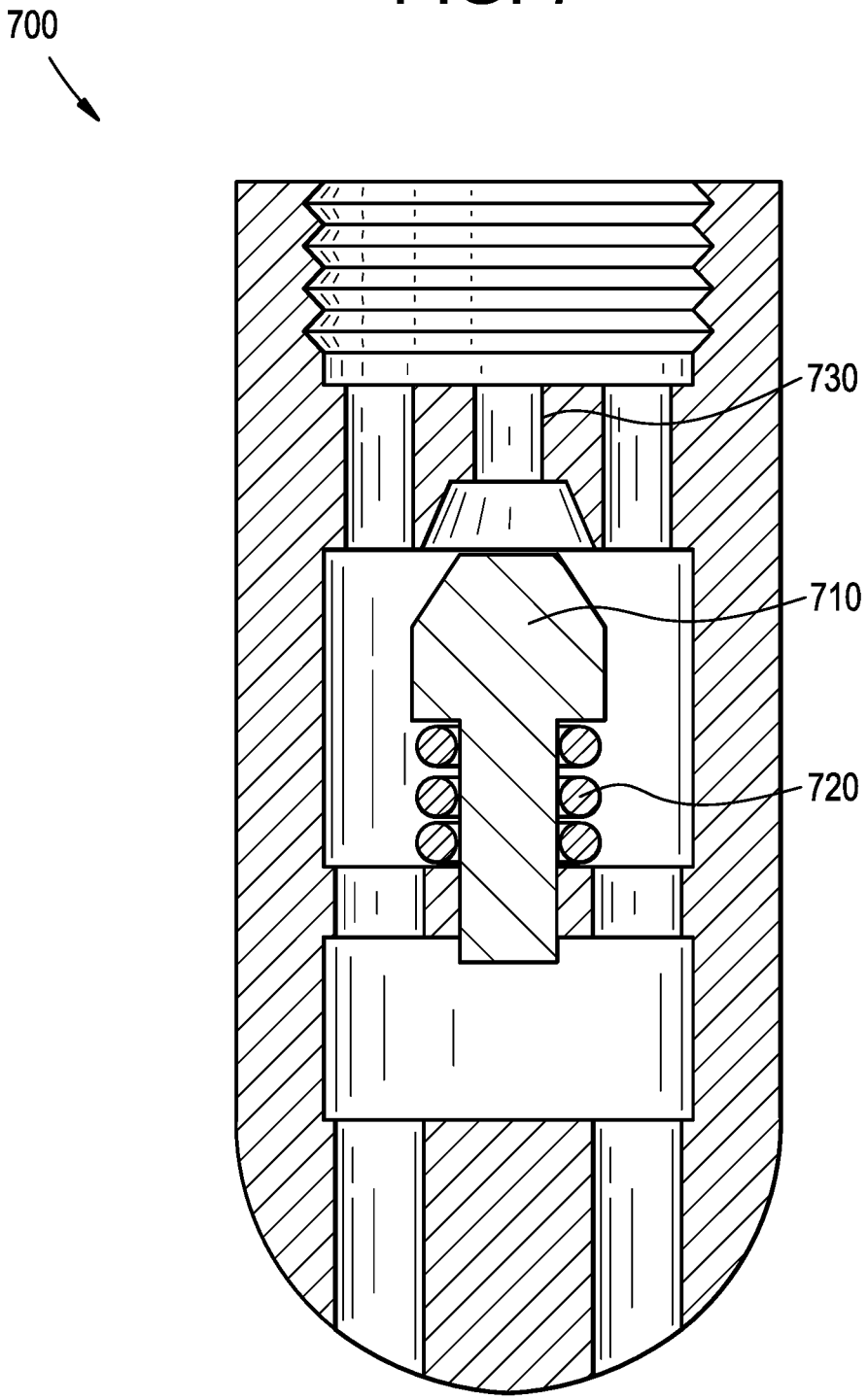
FIG. 7 depicts a float shoe, according to an embodiment.
Figure 8:
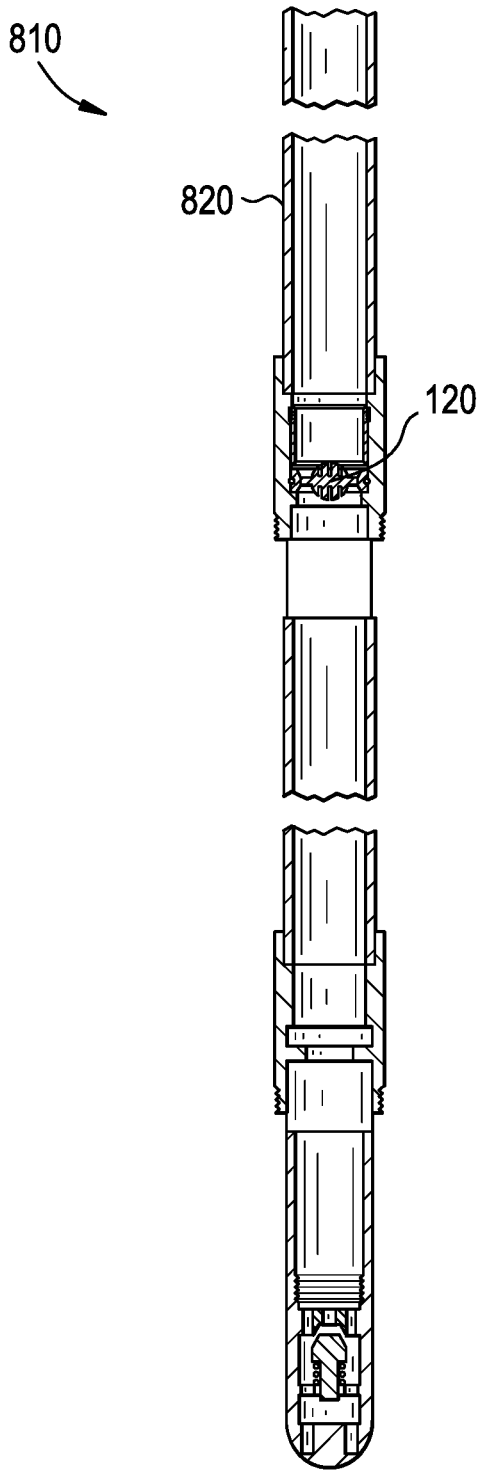
FIGS. 8-12 depict an operation sequence for utilizing a wiper plug and temporary seal, according to an embodiment.
Figure 9:
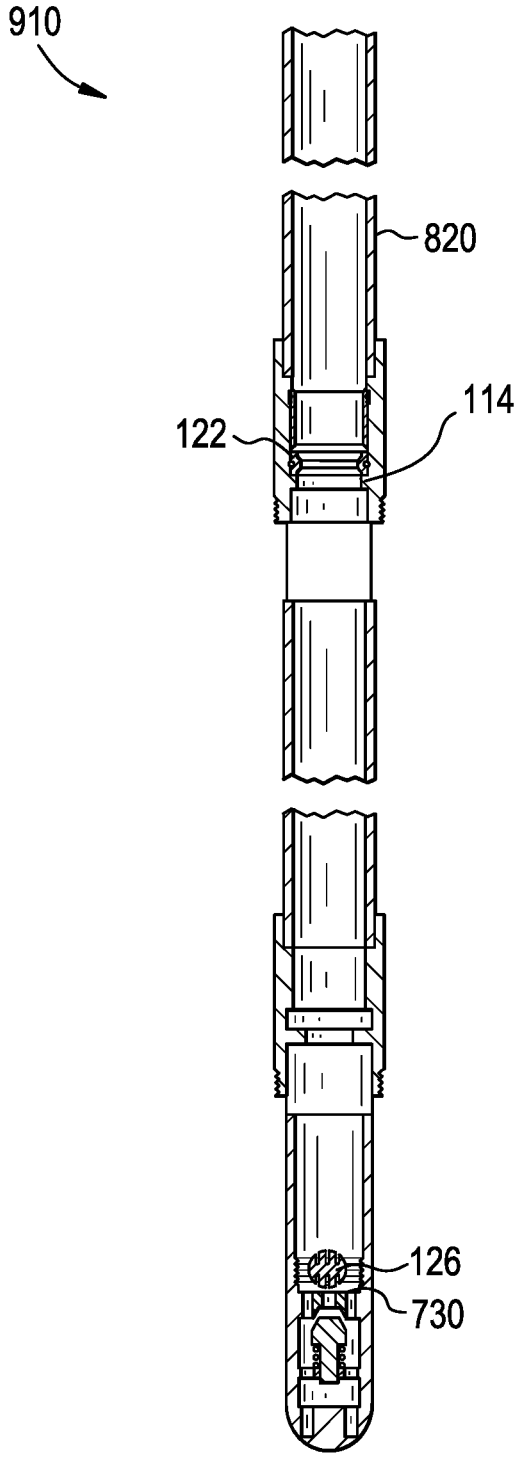
Figure 10:
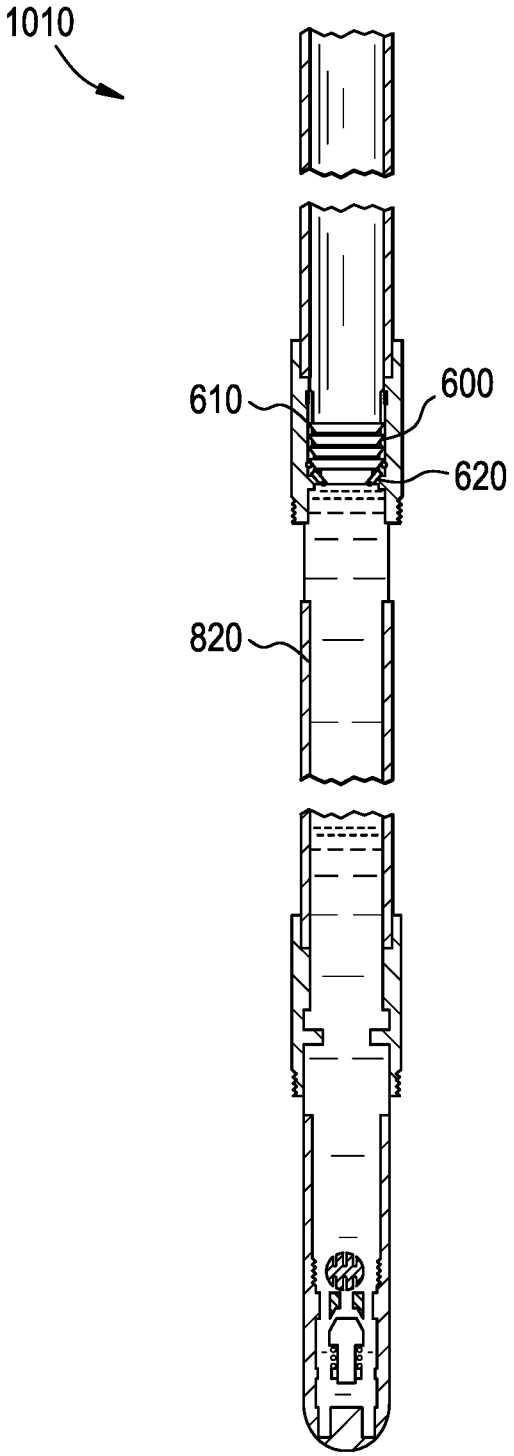
Figure 11:
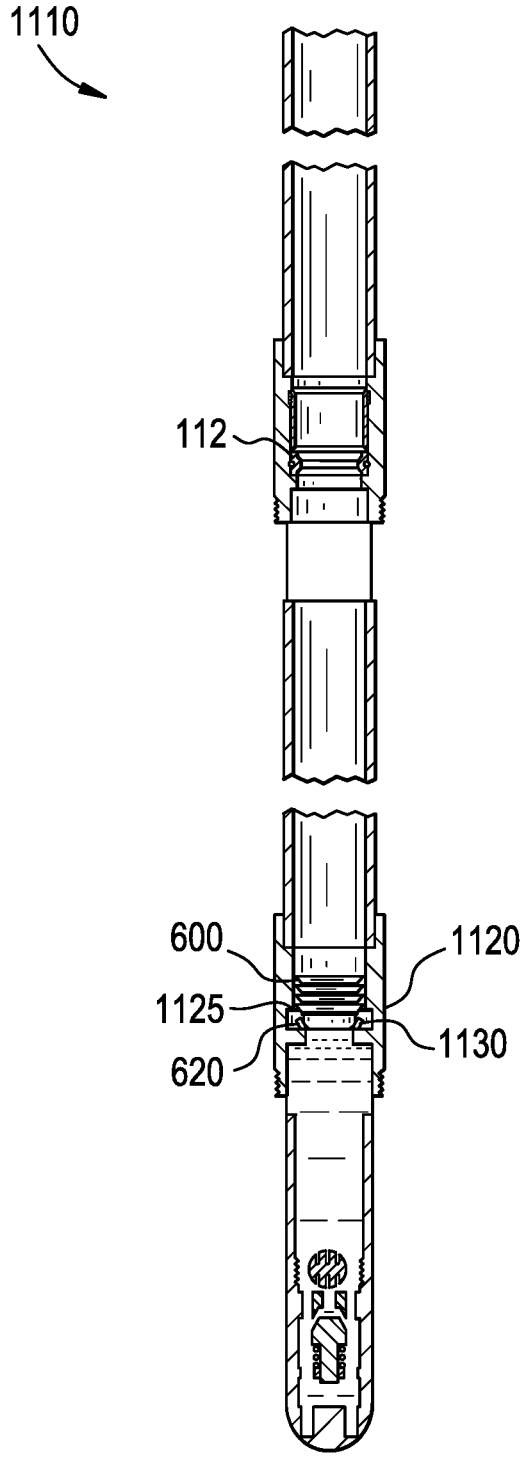
Figure 12:
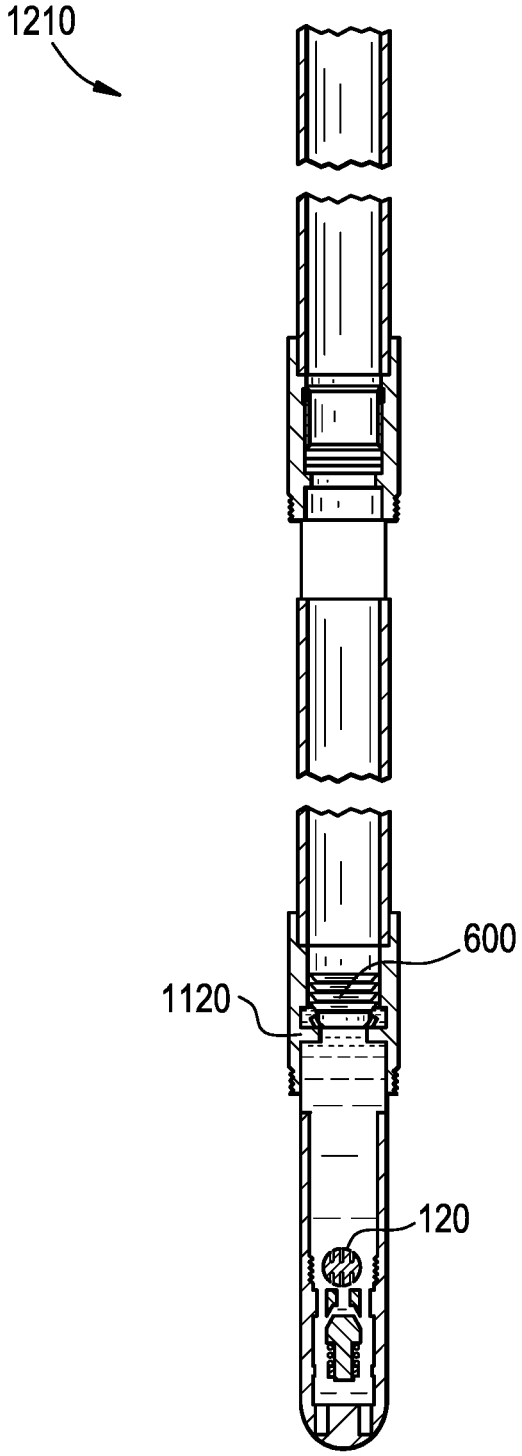

FIG. 7 depicts a float shoe 700, according to an embodiment. Float shoe 700 may be configured to be positioned on a distal end of a casing 705, and restrict reverse flow or cement slurry from the annulus into the casing 705. Float shoe 700 may also be configured to guide the casing towards the center of the hole. Float show 700 may include a valve 710, adjustable member 720, and insert 730.

Valve 710 may be a one way valve that is configured to open and close a passageway through insert 730 based on the flow of fluid through casing 705. Valve 705 may be configured to open responsive to flowing fluid form a first end of casing 705 towards a second end of casing 705, and close responsive to flowing fluid from the second end of casing 705 to the first end of casing 705.

Adjustable member 720 may be a spring, lift, etc. that is configured to apply pressure against valve 710. Adjustable member 720 may be configured to move valve 710 to a closed position if fluid is not flowing from the first end of casing 705 to a second end of casing 705. This may allow cement to flow through casing 705 and into an annulus, while prevent reverse flowing of the cement.

Insert 730 may be a seat with a passageway. Insert 730 may be configured to receive portions of a temporary seal that has travelled downhole, and allow the fluid travelling downhole to interact with the temporary seal sitting on insert 730. Further, insert 730 may have holes to allow for maximum flow rate to pass through it.

FIGS. 8-12 depict an operation sequence for utilizing a wiper plug and temporary seal, according to an embodiment. The operations of operational sequence presented below are intended to be illustrative. In some embodiments, operational sequence may be accomplished with one or more additional operations not described, and/or without one or more of the operations discussed. Additionally, the order in which the operations of operational sequence are illustrated in FIGURES and described below is not intended to be limiting. Furthermore, the operations of operational sequence may be repeated for subsequent valves or zones in a well.

At operation 810, casing 820 may be run in hole in a floating operation, and the casing may be set at a desired depth. While the casing 820 is run in hole, temporary seal 120 may be positioned on a seal seat 114, and may be intact. This may partition areas of the inner diameter of casing 820 above temporary seal 120 from areas of the inner diameter of casing 820 below temporary seal 120, which may be filled with a fluid with a lighter weight to achieve casing buoyancy.

At operation 910, a first portion 122 of temporary seal 120 may be separated from a second portion 126 of temporary seal 120. First portion 122 may be separated from second portion 126 of temporary seal 120 based on pressuring fluid within casing 820 and above the temporary seal 120, which increases the pressure on the weak points of temporary seal 120 past a pressure threshold.

At operation 1010, cement may be pumped within casing, and a wiper plug 600 may pumped downhole. Wiper plug 600 may have fins 610 that are configured to contact the inner circumference of casing 820 to clean and/or remove debris from the inner circumference of casing 820. Additionally, wiper plug 600 may assist in moving the cement towards the distal end of casing 820.

Furthermore, an outer diameter of wiper plug 600 may be equal or less than the inner diameter of casing 820, seat 114, and first portion 122 of temporary seal 120 remaining on seat 114. By having first portion 122 remaining on seat 114 while wiper plug 600 passes first portion 122 and seat 114, expandable members 620 on wiper plug may not expand and may further collapse.

At operation 1110, wiper plug 600 may be bumped downhole pushing the cement downhole. Wiper plug 600 may move downhole until wiper plug 600 is sitting on a landing collar 1120. Landing collar 1120 may have a recess, groove 1125 with an inner diameter that is greater than that of casing 820. Landing collar 1120 may also have a wiper seat 1130 that is equal, smaller than that of the inner diameter across casing 820. Responsive to wiper plug 600 be positioned on landing collar 1120, expandable segments 620 positioned on an end of wiper plug 600 may expand outward within groove 1125. Groove 1125 may be configured to restrict the movement of wiper plug 600 by interfacing with the expandable segments 620.

At operation 1210, the cement positioned within the wellbore may cure, and the first portion 122 of temporary seal 120 may further dissolve and disappear during this process, which may be after wiper plug 600 is positioned on landing collar 1120.

Figure 13:
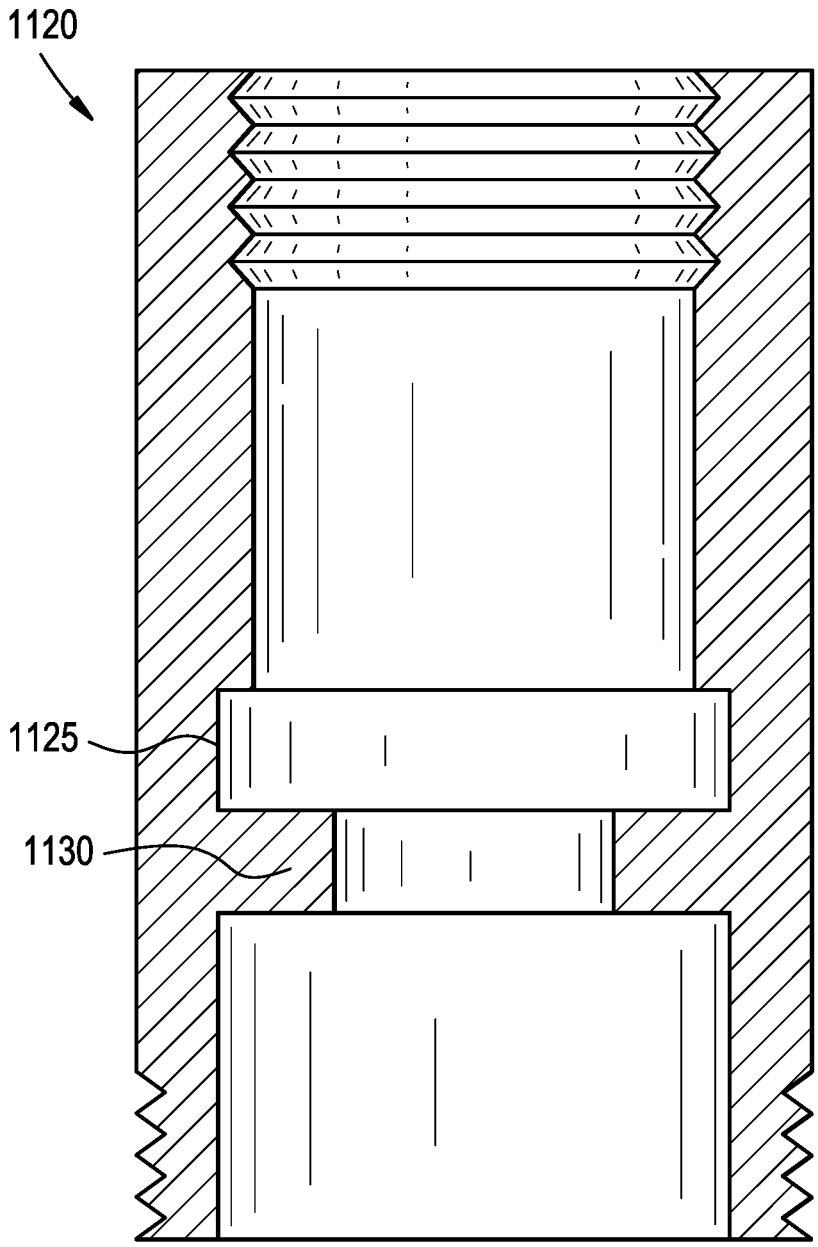
FIG. 13 depicts a landing collar, according to an embodiment.

FIG. 13 depicts a landing collar 1120, according to an embodiment. Landing collar 1120 may be configured to secure a wiper plug 600 in place after the wiper plug has travelled past a seal seat 114. Landing collar 1120 may include groove 1125 and landing seat 1130.

Groove 1125 may have a diameter that is larger than areas above and below groove 1125. This may enable expandable segments 620 of wiper plug 600 to expand outward to secure wiper plug 600 in place.

Landing seat 1130 may have a diameter that is equal, smaller than that of casing 110 and smaller than groove 1125. In embodiments, landing seat 1130 may be configured to allow a second portion of a temporary seal to pass through landing seat 1130 once the diameter of the second portion of the temporary seal is smaller than the diameter of landing seat 1130.

Figure 14:
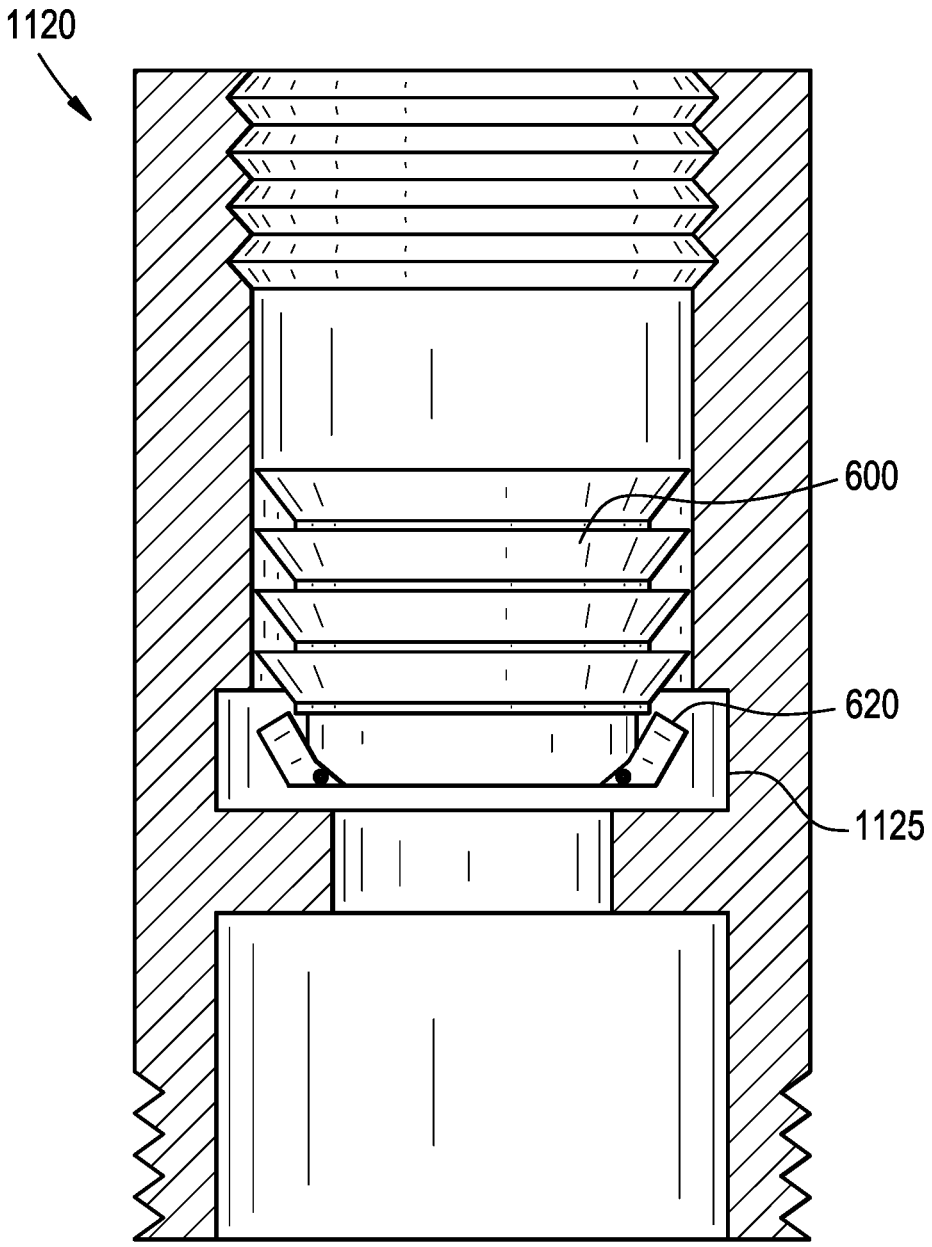
FIG. 14 depicts a wiper plug positioned on a landing collar, according to an embodiment

FIG. 14 depicts a wiper plug 600 positioned on a landing collar 1120, according to an embodiment.

Figure 15:
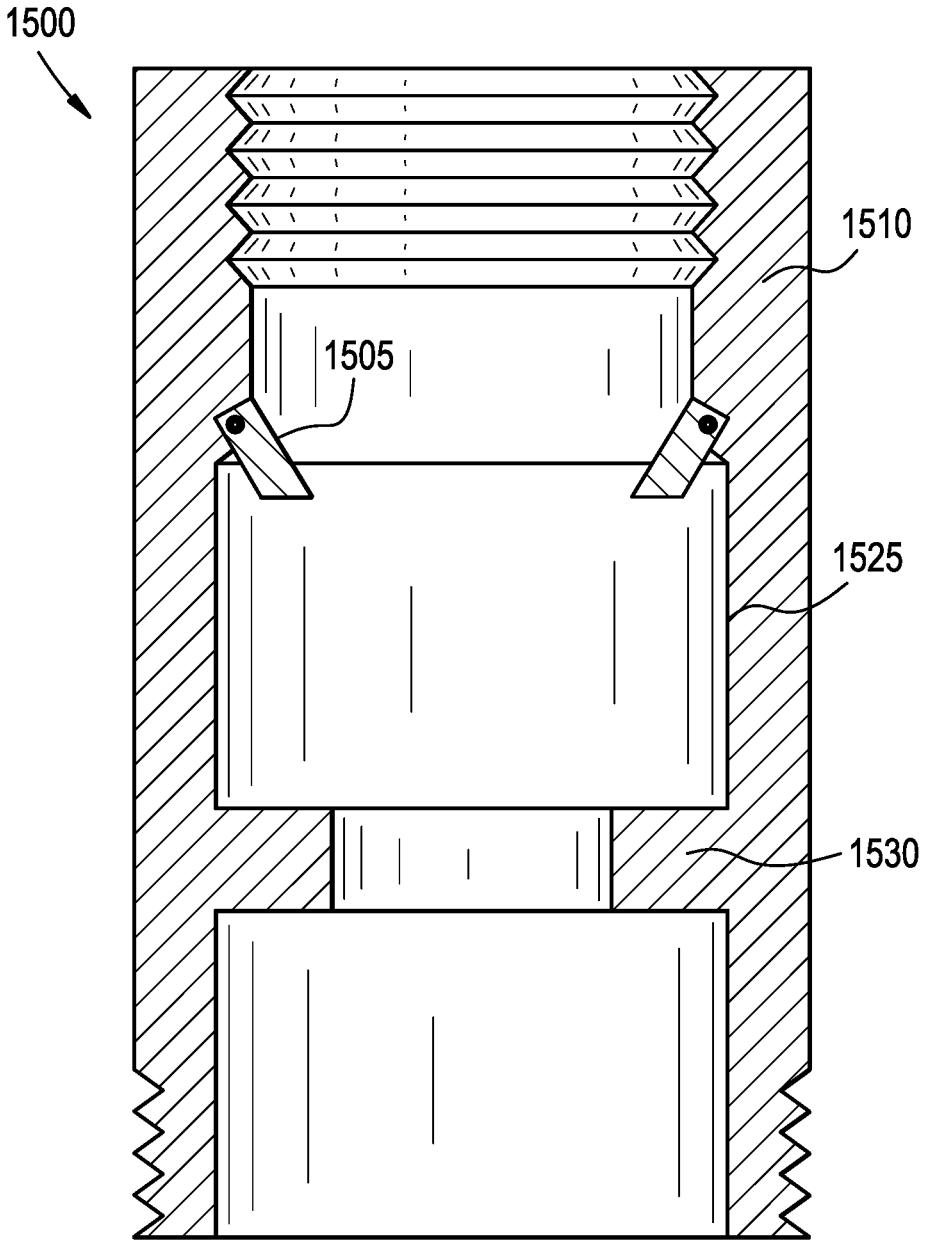
FIG. 15 depicts a landing collar, according to an embodiment

As depicted in FIG. 14, responsive to expandable segments 620 being aligned with groove 1125, expandable segments 620 may rotate downward to increase the diameter of wiper plug 600 to be greater than that of fins 610, and to be substantially similar to that of groove 1125. This may restrict the movement of wiper plug 600 upward. In another embodiment this expandable segment may be a ring that may expand circumferentially and prevent the wiper plug from moving upward FIG. 15 depicts a landing collar 1500, according to an embodiment. Landing collar 1500 may include expandable segments 1505, groove, 1525, and landing seat 1530.

Expandable segments 1505 may be one way hinges that are configured to rotate in a first direction responsive to pressure being applied against a first surface of expandable segments 1505. When the pressure is released from the first surface of the expandable segments 1505, the expandable segments 1505 may rotate in a second direction. This may enable expandable segments to rotate between a first position and a second position. When rotating from the first position to the second position, an inner diameter across expandable segments 1505 may increase in size. This may enable a wiper plug to pass through expandable segments 1505. However, once expandable segments 1505 rotate from the second position to the first position, the inner diameter across expandable segments 1505 may decrease in side, which may restrict the movement of the wiper plug. In another embodiment, the expandable segment may be a ring that may collapse circumferentially and prevent the wiper plug from moving upward Groove 1525 may be positioned between landing seat 1503 and expandable segments. Groove 1525 may have a larger diameter than that of landing seat 1530 and expandable segments 1505, even when expandable segments 1505 are in the second position.

Landing seat 1530 may be projections extending towards a central axis of landing collar 1530. Landing seat 1530 may be configured to receive the wiper plug to limit the movement of the wiper plug towards the distal end of the tool.

Figure 16:
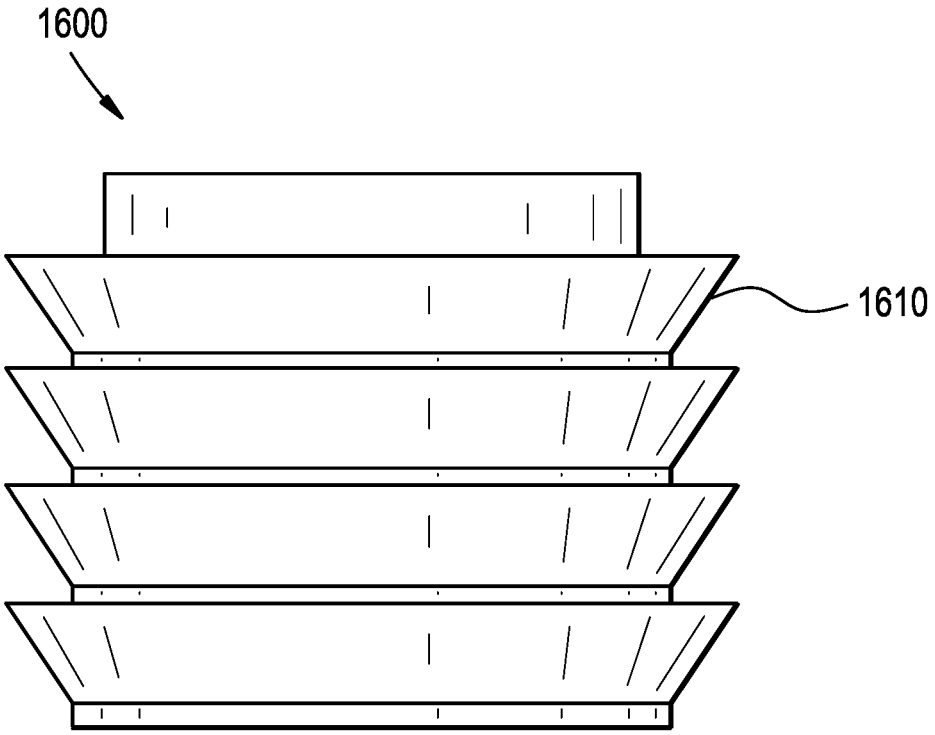
FIG. 16 depicts a wiper plug, according to an embodiment.

FIG. 16 depicts a wiper plug 1600, according to an embodiment. As depicted in FIG. 16, wiper plug 1600 may not include expandable segments, which may be positioned on the landing collar. Fins 1610 on wiper plug may have tapered sidewalls that decrease in size from the proximal end of wiper plug to the distal end of wiper plug 1600.

Figure 17:
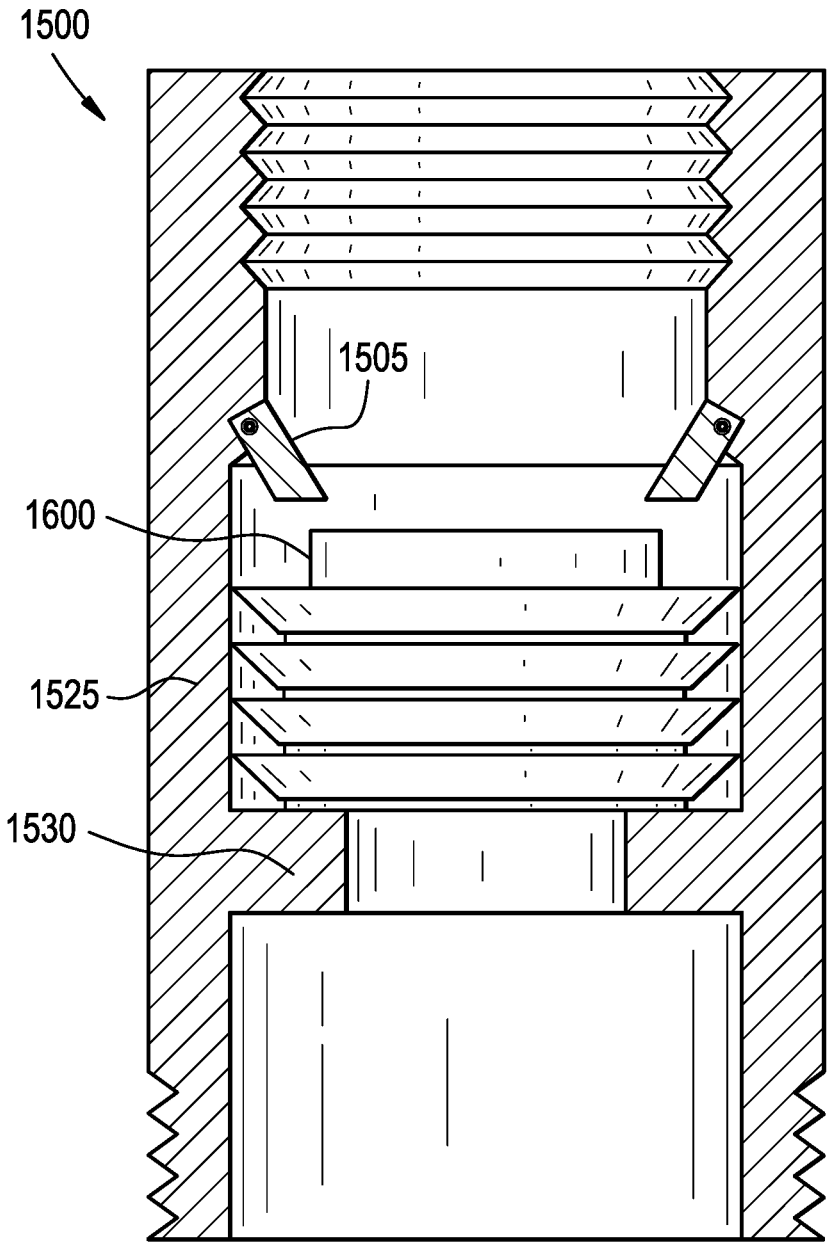
FIG. 17 depicts a wiper plug positioned on a landing collar, according to an embodiment.

FIG. 17 depicts a wiper plug 1600 positioned on a landing collar 1500. As depicted in FIG. 17 landing seat 1530 may have an inner diameter that is greater than that of a distal end of wiper plug 1600, which allows landing seat 1530 to receive and secure wiper plug 1600.

When wiper plug 1600 travels past expandable segments 1505, expandable segments 1505 may rotate inward to increase an inner diameter across expandable segments 1505. This may allow wiper plug 1600 to travel past expandable segments 1505. Once wiper plug 1600 stops applying pressure to the upper surfaces of expandable segments 1505 by passing expandable segments 1505, expandable segments 1505 may rotate outward to decrease the inner diameter across the expandable segments 1505. In other embodiments, the expandable segment 1505 maybe snap ring or any other component that has the ability to flex, collapse and/or expand.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for sealing a wellbore, the system comprising:

a unitary symmetrical temporary seal comprised of a first portion and a second portion, wherein a weak point is created between the first portion and the second portion, wherein in a first mode the first portion and the second portion are intact and in a second mode where the first portion and the second portion are decoupled from each other;

casing including a seal seat; the seal seat being configured to hold the first portion of the symmetrical temporary seal in the first mode and the second mode, the symmetrical temporary seal is run in hole in the first mode within the casing to achieve casing buoyancy by trapping a lighter weight fluid below the symmetrical temporary seal as the casing is run in hole;

wherein the symmetrical temporary seal including the weak point is symmetrical across a lateral axis and a longitudinal axis, and the symmetrical temporary seal continuously extends across the lateral axis and the longitudinal axis.

2. The system of claim 1, further comprising:

an insert configured to receive the second portion of the symmetrical temporary seal in the second mode, wherein the weak point having a smaller thickness than the first portion and the second portion, and the weak point is an indentation extending from an outer surface of symmetrical temporary seal towards the lateral axis, wherein the symmetrical temporary seal is made of dissolvable material that continuously extends across the lateral axis and the longitudinal axis, wherein the symmetrical temporary seal is formed is a single component.

3. The system of claim 2, further comprising:

a wiper plug with adjustable segments.

4. The system of claim 3, further comprising:

a landing collar with a variable internal diameter and a wiper seat.

5. The system of claim 4, further including a float shoe, the float shoe including the insert within a first passageway extending through the float shoe, where the insert includes at least one hole, wherein the second portion of the symmetrical temporary seal is configured to land on the insert when the second portion is decoupled from the first portion.

6. The system of claim 5, wherein the wiper plug is configured to push the second portion of the symmetrical temporary seal and cement through the first passageway and into an annulus after the first portion of the symmetrical temporary seal is decoupled from the second portion of the symmetrical temporary seal.

7. The system of claim 2, wherein the wiper plug has a variable diameter the wiper plug passes through different diameters.

8. The system of claim 1, further comprising:

a landing collar with adjustable segments that are configured to retract responsive to a wiper plug applying force against the adjustable segments, and the adjustable segments being configured to expand responsive to removing the applied force to restrict movement of the wiper plug.

9. The system of claim 1, further comprising:

a landing collar configured to receive a wiper plug, the landing collar including a recess.

10. A method for sealing a wellbore, the method system comprising:

positioning a first portion of a unitary symmetrical temporary seal on a seal seat, the symmetrical temporary seal including the first portion and a second portion, wherein a weak point is created between the first portion and the second portion, wherein in a first mode the first portion and the second portion are intact and in a second mode where the first portion and the second portion are decoupled from each other;

running the symmetrical temporary in hole in the first mode within casing to achieve casing buoyancy by trapping a lighter weight fluid below the symmetrical temporary seal as the casing is run in hole;

wherein the symmetrical temporary seal including the weak point is symmetrical across a lateral axis and a longitudinal axis, and the symmetrical temporary seal continuously extends across the lateral axis and the longitudinal axis.

11. The method of claim 10, further comprising:

positioning the second portion of the symmetrical temporary seal on an insert, wherein the weak point having a smaller thickness than the first portion and the second portion, wherein the symmetrical temporary seal is made of dissolvable material that continuously extends across the lateral axis and the longitudinal axis, wherein the symmetrical temporary seal is formed is a single component, and the weak point is an indentation extending from an outer surface of symmetrical temporary seal towards the lateral axis.

12. The method of claim 11, further comprising:

changing a wiper plug diameter as the wiper plug passes through different diameters.

13. The method of claim 12, further comprising:

positioning the wiper plug on a landing collar, wherein the landing collar includes a variable internal diameter and a wiper seat.

14. The method of claim 13, further including:

a float shoe, the float shoe including the insert within a first passageway extending through the float shoe, where the insert includes at least one hole; and landing the second portion of the symmetrical temporary seal on the insert when the second portion is decoupled from the first portion.

15. The method of claim 14, further comprising:

pushing cement and the second portion of the symmetrical temporary seal through the first passageway and into an annulus after the first portion of the symmetrical temporary seal is decoupled from the second portion of the symmetrical temporary seal.

16. The method of claim 12, further comprising:

changing a diameter of the wiper plug as the wiper plug passes through different diameters.

17. The method of claim 10, further comprising:

retracting adjustable segments on a landing collar responsive to a wiper plug applying force against the adjustable segments, and adjusting the adjustable responsive to removing the applied force to restrict movement of the wiper plug.

18. The method of claim 10, further comprising:

positioning a wiper plug on a landing collar, wherein the landing collar includes a recess.

* * * * *